252-99 AU 166 EX
4/20/82 XR 4,325,828

United States Patent [19]
Postlethwaite

[11] 4,325,828
[45] Apr. 20, 1982

[54] DETERGENT BLEACH COMPOSITIONS

[75] Inventor: Dennis Postlethwaite, Birkenhead, England

[73] Assignee: Lever Brothers Company, New York, N.Y.

[21] Appl. No.: 244,499

[22] Filed: Mar. 19, 1981

[30] Foreign Application Priority Data

Mar. 27, 1980 [GB] United Kingdom ..... 10318/80
Jun. 16, 1980 [GB] United Kingdom ..... 19605/80

[51] Int. Cl.³ ..... C11D 7/54
[52] U.S. Cl. ..... 252/102; 252/95; 252/98; 252/99; 252/186
[58] Field of Search ..... 252/95, 98, 99, 102

[56] References Cited

U.S. PATENT DOCUMENTS 4,100,095 7/1978 Hutchins et al. ..... 252/99
4,128,495 12/1978 McCrudden ..... 252/99 X
4,154,695 5/1979 McCrudden et al. ..... 252/102 X
4,228,452 9/1980 Leigh ..... 252/102
4,259,200 3/1981 Sims et al. ..... 252/102
4,265,776 5/1981 Gohla et al. ..... 252/99 X

*Primary Examiner*—Mayer Weinblatt
*Attorney, Agent, or Firm*—Melvin H. Kurtz

[57] ABSTRACT

A solid detergent bleach composition adapted for use at substantially any washing temperature, comprising essentially a detergent active compound and a synergistic mixture of a solid organic peroxy acid compound e.g. diperoxyazelaic acid, an inorganic peroxy compound e.g. sodium perborate and a stabilizing sequestering agent. The composition which is preferably presented in the form of a particulate product, shows improved bleaching effect at substantially all washing temperatures. It has also advantages over compositions comprising bleaching activators in that it does not suffer from problems of in situ peroxy acid generation.

5 Claims, No Drawings

DETERGENT BLEACH COMPOSITIONS

TECHNICAL FIELD

The invention relates to detergent bleach compositions and in particular to solid detergent bleach compositions adapted for use at substantially any washing temperature.

It is well known in washing and/or bleaching of textiles to make use of compositions containing inter alia inorganic peroxy compounds, such as the alkali metal perborates, percarbonates, perphosphates, persilicates, hydrogen peroxide and sodium peroxide, having a bleaching effect on the textiles treated therewith. However, washing and/or bleaching compositions containing such inorganic peroxy compounds generally have the disadvantage that their bleaching effect is relatively low at temperatures below 80° C. and substantially nil at temperatures below 60° C., which gives rise to difficulties when these compositions are used in domestic washing machines wherein the temperature of the wash water is not higher than 70° C.

The addition of organic bleaching activators for the peroxy compound to such compositions is known, owing to which the active oxygen of the peroxy compound becomes effective also at temperatures below 80° C. Such compositions are believed to function by the generation of organic peroxyacids during use, for example peroxyacetic acid. A fundamental problem in this type of systems is that the peroxyacid is generated in situ which under practical conditions gives rise to yield difficulties.

BACKGROUND ART

U.S. Pat. No. 4,128,495 discloses bleaching compositions comprising phthaloyl peroxide and sodium perborate. Phthaloyl peroxide is a peroxyacid precursor and is hydrolysed or perhydrolysed in aqueous medium to produce monoperoxyphthalic acid or diperoxyphthalic acid. Detergent and/or bleaching compositions comprising organic peroxyacids, such as diperoxyisophthalic acid, are also known from e.g. British Pat. Nos. 1,387,167; 1,456,591 and U.S. Pat. No. 4,100,095.

British Pat. No. 1,269,677 discloses bleaching compositions comprising a percarboxylic acid, e.g. perbenzoic acid, and an inorganic persulphate, particularly the mixed salt $KHSO_4$, $K_2SO_4$, $2KHSO_5$.

DISCLOSURE OF THE INVENTION

It is an object of the present invention to provide a detergent bleach composition having an improved bleaching effect at substantially all washing temperatures.

It has now been found that this object can be achieved by using a synergistic mixture of a solid organic peroxyacid compound, an inorganic peroxy compound generating $H_2O_2$ in solution and a stabilizing sequestering agent.

Accordingly the invention provides a solid detergent bleach composition, characterised in that it comprises essentially a detergent active compound, a solid organic peroxyacid compound, an inorganic peroxy compound which generates hydrogen peroxide in solution and a stabilising sequestering agent as hereinafter defined.

The organic peroxyacid compounds used in the present invention are solid at room temperature and should preferably have a melting point of at least 50° C.

Such peroxyacid compounds are the organic peroxyacids and water-soluble salts thereof having the general formula:

$$HO-O-\overset{\overset{\displaystyle O}{\|}}{C}-R-Y,$$

wherein R is an alkylene group containing 1 to 16 carbon atoms or an arylene group containing from 6 to 8 carbon atoms and Y is hydrogen, halogen, alkyl, aryl or any group which provides an anionic moiety in aqueous solution. Such Y groups can include, for example:

$$-\overset{\overset{\displaystyle O}{\|}}{C}-OM;\quad -\overset{\overset{\displaystyle O}{\|}}{C}-O-OM;\quad \text{or}\quad -\underset{\underset{\displaystyle O}{\|}}{\overset{\overset{\displaystyle O}{\|}}{S}}-OM$$

wherein M is H or a water-soluble, salt-forming cation.

The organic peroxyacids and salts thereof usable in the present invention can contain either one or two peroxy groups and can be either aliphatic or aromatic. When the organic peroxyacid is aliphatic, the unsubstituted acid may have the general formula:

$$HO-O-\overset{\overset{\displaystyle O}{\|}}{C}-(CH_2)_n-Y$$

wherein Y can be $$-CH_3,\ -CH_2Cl,\ -\overset{\overset{\displaystyle O}{\|}}{C}-OM,\ -\underset{\underset{\displaystyle O}{\|}}{\overset{\overset{\displaystyle O}{\|}}{S}}-OM\ \text{or}\ -\overset{\overset{\displaystyle O}{\|}}{C}-O-OM$$

and n can be an integer from 1 to 12. Peroxyazelaic acids (n=7) are the most preferred compounds of this type, particularly diperoxyazelaic acid. Examples of other preferred compounds of this type are diperoxyadipic acid and diperoxysebacic acid.

When the organic peroxyacid is aromatic, the unsubstituted acid may have the general formula:

$$HO-O-\overset{\overset{\displaystyle O}{\|}}{C}-C_6H_4-Y$$

wherein Y is, for example, hydrogen, halogen, alkyl, $$-\overset{\overset{\displaystyle O}{\|}}{C}-OM;\quad -\underset{\underset{\displaystyle O}{\|}}{\overset{\overset{\displaystyle O}{\|}}{S}}-OM\quad \text{or}\quad -\overset{\overset{\displaystyle O}{\|}}{C}-O-OM.$$

The percarboxy and Y groupings can be in any relative position around the aromatic ring. The ring and/or Y group (if alkyl) can contain any non-interfering substituents such as halogen or sulphonate groups. Examples of suitable aromatic peroxyacids and salts thereof include monoperoxyphthalic acid, diperoxyterephthalic acid, 4-chlorodiperoxyphthalic acid, m-chloroperoxybenzoic acid, p-nitroperoxybenzoic acid and diperoxyisophthalic acid. Preferred aromatic peroxyacids are monoperoxyphthalic acid and diperoxyisophthalic acid.

The amount of organic peroxy acid compound in the composition of the invention will generally be in the range of from 1 to 25% by weight, preferably from 2 to 10% by weight.

The inorganic peroxy compounds usable in the present invention are compounds which liberate hydrogen peroxide in aqueous solutions. Examples of such inorganic peroxy compounds are the perborates, the perortho-, perpyro- and perpolyphosphates, and the percarbonates; the perborates, particularly the alkali metal perborates, being preferred because of their commercial availability. They can be present in the tetrahydrate form as well as in partially dehydrated forms up to the lowest hydrate form.

The amount of inorganic peroxy compound in the composition of the invention will generally be in the range of from 2 to 40% by weight, preferably from 5 to 30% by weight.

The sequestering agents usable in the present invention should have the ability of stabilising the bleach system by inhibiting the mutual decomposition reaction between the peroxyacid and the inorganic peroxycompound. Examples of such sequestering agents are compounds having the following general formulae I, II and III:

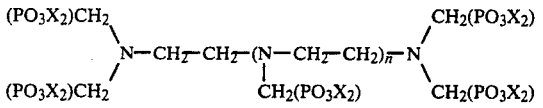

I.

wherein n is an integer from 0 to 4 and X is H or an alkali metal, alkaline earth metal or ammonium cation;

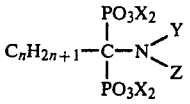

II.

wherein n is an integer from 0 to 2; X is H or an alkali metal, alkaline earth metal or ammonium cation;

$Y = CH_2COOX$ or $CH_2PO_3X_2$;

$Z = CH_2COOX$ or $CH_2PO_3X_2$;

(X = H or alkali, alkaline earth metal or ammonium cation);

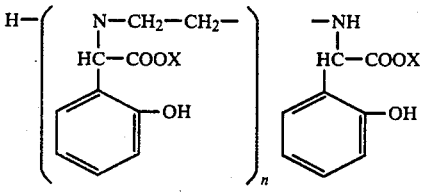

wherein n is 1–3 and X is H, or an alkali metal, alkaline earth metal or ammonium cation.

These sequestering agents are disclosed in U.S. Pat. No. 4,225,452 and British Pat. No. 1,392,284.

The amount of sequestering agent used in the composition of the invention will generally be in the range of from 0.05 to 5% by weight, preferably from 0.1 to 2% by weight. The detergent bleach compositions of the invention will also contain at least one detergent active compound, which may be anionic, cationic, nonionic or amphoteric in character, the amount of which generally will be from about 3 to about 40%, preferably from 10 to 35% by weight.

Generally mixtures of the above detergent active compounds are used; mixtures of anionic and nonionic detergent active compounds are commonly used.

Typical anionic detergent-active compounds are water-soluble or water-dispersible salts of various organic acids. The cations of such salts are generally alkali-metals, such as sodium and, less preferably, potassium, but other cations, such as ammonium and substituted ammonium, can be used if desired. Examples of suitable organic acids are: alkyl benzene sulphonic acids, the alkyl chains of which contain from about 8 to about 20 carbon atoms, such as p-dodecyl benzene sulphonic acid and linear alkyl ($C_{10-15}$) benzene sulphonic acid; the mixtures of sulphonic acids obtained by reacting linear and branched olefins, particularly linear "cracked-wax" or "Ziegler" alpha-olefins, containing from about 8 to about 22 carbon atoms, with sulphur trioxide; alkyl sulphonic acids obtained by reacting alkanes containing from about 8 to about 22 carbon atoms with sulphur dioxide/oxygen or sulphur dioxide/chlorine (followed by hydrolysis in the latter case), or by the addition of bisulphite to olefins, particularly linear "cracked-wax" or "Ziegler" alpha-olefins, containing from about 8 to about 22 carbon atoms; alkyl sulphuric acids obtained by reacting aliphatic alcohols containing from about 8 to about 22 carbon atoms with sulphur trioxide; alkyl ether sulphuric acids, obtained by reacting molar quantities of aliphatic alcohols containing from about 6 to about 18 carbon atoms with from about 1 to about 15 moles of ethylene oxide, or a suitable mixture of ethylene oxide and propylene oxide, and subsequently reacting the alkoxylated alcohol with sulphur trioxide to yield the required acid; and natural or synthetic aliphatic carboxylic acids, particularly those derived from natural sources such as tallows, coconut oil, palm oil, palm kernel oil and groundnut oil.

Examples of suitable nonionic detergent-active compounds are condensates of alkyl-phenols having an alkyl group (derived, for example, from polymerized propylene, diisobutylene, octene, dodecene or nonene) containing from about 6 to 12 carbon atoms in either a straight chain or branched chain configuration, with about 5 to 25 moles of ethylene oxide per mole of alkylphenol; condensates containing from about 40 percent to about 80 percent polyoxyethylene by weight and having a molecular weight of from about 5,000 to about 11,000 resulting from the reaction of ethylene oxide with the reaction product of ethylenediamine and excess propylene oxide; condensates of linear or branched-chain aliphatic alcohols containing from 8 to 18 carbon atoms with ethylene oxide, e.g. a coconut alcohol-ethylene oxide condensate containing about 6 to 30 moles of ethylene oxide per mole of coconut alcohol; long-chain tertiary amine oxides corresponding to the general formula $R_1R_2R_3N \rightarrow O$, wherein $R_1$ is an alkyl radical containing from about 8 to 18 carbon atoms and $R_2$ and $R_3$ are each methyl, ethyl or hydroxy ethyl radicals, such as dimethyldodecylamine oxide, dimethyloctylamine oxide, dimethylhexadecylamine oxide and N-bis (hydroxyethyl) dodecylamine oxide; long-chain tertiary phosphine oxides corresponding to the general formula $RR'R''P \rightarrow O$, wherein R is an alkyl, alkenyl or monohydroxyalkyl radical containing from 10 to 18 carbon atoms and R' and R'' are each alkyl or monohydroxyalkyl groups containing from one to three carbon atoms, such as dimethyldodecylphosphine oxide, dimethyltetradecylphosphine oxide, ethylmethyltetradecylphosphine oxide, dimethylstearylphosphine oxide, ethylpropylcetylphosphine oxide, diethyldodecylphosphine oxide, bis (hydroxymethyl) dodecylphosphine oxide, bis (2-hydroxyethyl) dodecylphosphine oxide, 2-hydroxypropylmethyltetradecylphosphine oxide, dimethyloleylphosphine oxide and dimethyl-2-hydroxydodecylphosphine oxide; and dialkyl sulphoxides corresponding to the general formula RR'S→O, wherein R is an alkyl, alkenyl, beta- or gamma-monohydroxyalkyl radical or an alkyl or beta- or gamma-monohydroxyalkyl radical containing one or two other oxygen atoms in the chain, the R groups containing from 10 to 18 carbon atoms and wherein R' is methyl, ethyl or alkylol radical, such as dodecyl methyl sulphoxide, tetradecyl methyl sulphoxide, 3-hydroxytridecyl methyl sulphoxide, 2-hydroxydodecyl methyl sulphoxide, 3-hydroxy-4-dodecyloxybutyl methyl sulphoxide, 2-hydroxy-3-decyloxypropyl methyl sulphoxide, dodecyl ethyl sulphoxide, 2-hydroxydodecyl ethyl sulphoxide and dodecyl-2-hydroxyethyl sulphoxide.

Examples of suitable amphoteric detergent-active compounds are: derivatives of aliphatic secondary and tertiary amines, in which the aliphatic radical may be straight chain or branched and wherein one of the aliphatic substituents contains from about 8 to 18 carbon atoms and one contains an anionic water solubilizing group, such as sodium-3-dodecylaminopropionate, sodium-3-dodecylaminopropanesulphonate and sodium N-2-hydroxydodecyl-N-methyl-taurate; and derivatives of aliphatic quaternary ammonium compounds, sulphonium compounds and phosphonium compounds in which the aliphatic radical may be straight chain or branched and wherein one of the aliphatic substituents contains from about 8 to 18 carbon atoms and one contains an anionic water solubilizing group, such as 3-(N,N-dimethyl-N-hexadecylammonium) propane-1-sulphonate betaine, 3-(N,N-dimethyl-N-hexadecylammonium)-2-hydroxy-propane-1-sulphonate betaine, 3-(dodecylmethylsulphonium) propane-1-sulphonate betaine, and 3-(cetylmethylphosphonium) ethane sulphonate betaine.

Further examples of suitable detergent-active compounds commonly used in the art are given in "Surface Active Agents, Volume I" by Schwartz and Perry (Interscience 1949) and "Surface Active Agents, Volume II" by Schwartz, Perry and Berch (Interscience 1958), the disclosures of which are included by reference herein.

Hence in a more specific embodiment of the invention, a detergent bleach composition will comprise:

(a) from 3 to 40%, preferably 10–35%, by weight of a detergent active compound;
(b) from 1 to 25%, preferably 2–10%, by weight of a solid organic peroxyacid compound;
(c) from 2 to 40%, preferably 5–30%, by weight of an inorganic peroxy compound, and
(d) from 0.05 to 5%, preferably 0.1–2%, by weight of a stabilising sequestering agent.

Generally, a detergent composition of the invention will also include one or more detergency builders. Usually the total amount of detergency builders in a detergent composition of the invention will be from about 5 to about 70 percent by weight of the detergent composition. Many detergency builders are known, and those skilled in the art of formulating fabric-washing detergent compositions will be familiar with these materials. Examples of known detergency builders are sodium tripolyphosphate; sodium orthophosphate; sodium pyrophosphate; sodium trimetaphosphate; sodium ethane-1-hydroxy-1,1-diphosphonate; sodium carbonate; sodium silicate; sodium citrate; sodium oxydiacetate; sodium nitrilotriacetate; sodium ethylenediaminetetraacetate; sodium salts of long-chain dicarboxylic acids, for instance straight chain ($C_{10}$ to $C_{20}$) succinic acids and malonic acids; sodium salts of alpha-sulphonated long-chain monocarboxylic acids; sodium salts of polycarboxylic acids; i.e. acids derived from the polymerization or copolymerization of unsaturated carboxylic acids and unsaturated carboxy acid anhydrides such as maleic acid, acrylic acid, itaconic acid, methacrylic acid, crotonic acid and aconitic acid, and the anhydrides of these acids, and also from the copolymerization of the above acids and anhydrides with minor amounts of other monomers, such as vinyl chloride, vinyl acetate, methyl methacrylate, methyl acrylate and styrene; and modified starches such as starches oxidized, for example using sodium hypochlorite, in which some anhydroglucose units have been opened to give dicarboxyl units.

Further, a detergent composition of the invention may contain any of the conventional detergent composition ingredients in any of the amounts in which such conventional ingredients are usually employed therein. Examples of these additional ingredients are lather boosters, such as coconut mono-ethanolamide and palm kernel monoethanolamine; lather controllers; inorganic salts such as sodium sulphate and magnesium sulphate; antiredeposition agents, such as sodium carboxymethylcellulose; and, usually present only in minor amounts, perfumes, colorants, fluorescers, corrosion inhibitors, germicides and enzymes.

The detergent bleach compositions of the invention are preferably particulate, either flowable powders or aggregates.

They can be prepared using any of the conventional manufacturing techniques commonly used or proposed for the preparation of particulate detergent compositions, such as dry mixing, or slurry making followed by spray-drying or spray-cooling and subsequent dry-dosing of sensitive ingredients, e.g. the synergistic mixture of the solid organic peroxyacid compound, the inorganic peroxyhydrate salt and the sequestering agent.

Other conventional techniques for taking precautions to minimise undue and undesirable interactions between the bleaching agents and other components of the detergent compositions, such as noodling, granulation, pelletising etc. may be utilised as and when necessary.

The invention will now be illustrated by way of the following examples:

EXAMPLE I

Bleach tests on tea stains were carried out using the following spray-dried detergent base powder, to which there were added varying amounts of bleaching agent:

| Base powder composition: | % by weight |
|---|---|
| sodium alkyl benzene sulphonate | 18.4 |
| coconut fatty acid monoethanolamide | 3.5 |
| sodium triphosphate | 40.3 |
| sodium toluene sulphonate | 2.3 |
| alkaline sodium silicate | 12.7 |
| sodium sulphate | 12.2 |
| water | 10.6 |

Bleach test results in heat-up wash cycles using detergent bleaching compositions at 5 g/l product concentration expressed as $\Delta R_{460}$* values as measured on Elrepho Spectroreflectometer are shown in the following tables.

DPAA = Diperoxyazelaic acid.

Perborate = Sodium perborate tetrahydrate.

Sequestrant = Ethylene diamine trimethylene phosphonic acid.

I. Effect of DPAA and perborate level

TABLE 1a

| System | Bleach response ($\Delta R_{460}$*) wash temp. 40° C. wash time 20 min. | 60° C. 40 min. | 80° C. 60 min. |
|---|---|---|---|
| + 5% DPAA | 4.0 | 12.5 | 17.4 |
| + 5% DPAA + 10% Perborate | 5.4 | 13.0 | 16.8 |
| + 5% DPAA + 10% Perborate + 0.2% sequestrant | 5.4 | 14.7 | 21.1 |

TABLE 1b

| System | Bleach response ($\Delta R_{460}$*) wash temp. 40° C. wash time 20 min. | 60° C. 40 min. | 80° C. 60 min. |
|---|---|---|---|
| + 10% DPAA | 11.6 | 19.9 | 23.8 |
| + 10% DPAA + 10% Perborate | 14.0 | 19.5 | 22.0 |
| + 10% DPAA + 10% Perborate + 0.2% sequestrant | 14.1 | 20.7 | 25.4 |

EXAMPLE II

Bleach tests on tea stains were carried out using the spray-dried detergent base powder of Example I to which different types of bleaching systems were added.

In all cases the test compositions contain peroxyacid (PA) in an amount to give 0.9 millimolar of [COOO−] in solution, 10% by weight of sodium perborate (Perb.), if any, and 0.2% by weight of the sequestrant ethylene diamine tetra(methylene phosphonic acid), "EDTMP", if any.

TABLE 2a

| System | Bleach response (Δ R 460) wash temp. 30° C. wash time (min) 10 | 40° C. 20 | 50° C. 30 | 60° C. 40 | 70° C. 53 | 80° C. 65 |
|---|---|---|---|---|---|---|
| PA | −0.5 | 0.2 | 1.2 | 2.1 | 5.6 | 9.8 |
| PA + Perb. | −0.2 | 0.9 | 1.4 | 5.4 | 9.1 | 13.0 |
| PA + Perb. + EDTMP | −0.1 | 0.9 | 2.2 | 7.0 | 11.2 | 14.7 |

PA = Diperoxyadipic acid.

TABLE 2b

| System | Bleach response (Δ R 460) wash temp. 30° C. wash time (min) 10 | 40° C. 20 | 50° C. 30 | 60° C. 40 | 70° C. 53 | 80° C. 65 |
|---|---|---|---|---|---|---|
| PA | 0.2 | 1.4 | 3.6 | 6.6 | 11.3 | 13.9 |
| PA + Perb. | 0.9 | 1.5 | 3.5 | 7.5 | 12.5 | 15.8 |
| PA + Perb. + EDTMP | 1.2 | 1.8 | 4.4 | 10.4 | 15.1 | 18.7 |

PA = Diperoxyazelaic acid.

TABLE 2c

| System | Bleach response (Δ R 460) wash temp. 30° C. wash time (min) 10 | 40° C. 20 | 50° C. 30 | 60° C. 40 | 70° C. 53 | 80° C. 65 |
|---|---|---|---|---|---|---|
| PA | 0.9 | 1.2 | 1.7 | 5.7 | 9.2 | 12.9 |
| PA + Perb. | 1.6 | 2.0 | 3.8 | 4.8 | 12.3 | 15.8 |
| PA + Perb. + EDTMP | 1.5 | 2.4 | 5.0 | 9.7 | 14.8 | 18.8 |

PA = Diperoxysebacic acid

TABLE 2d

| System | Bleach response (Δ R 460) wash temp. 30° C. wash time (min) 10 | 40° C. 20 | 50° C. 30 | 60° C. 40 | 70° C. 53 | 80° C. 65 |
|---|---|---|---|---|---|---|
| PA | 0.4 | 1.5 | 3.3 | 9.2 | 11.3 | 13.3 |
| PA + Perb. | 0.2 | 1.9 | 4.2 | 10.2 | 12.7 | 16.0 |
| PA + Perb. + EDTMP | 0.4 | 2.0 | 4.9 | 11.8 | 14.8 | 17.8 |

PA = Diperoxydodecanoic acid.

TABLE 2e

| System | Bleach response (Δ R 460) wash temp. 30° C. wash time (min) 10 | 40° C. 20 | 50° C. 30 | 60° C. 40 | 70° C. 53 | 80° C. 65 |
|---|---|---|---|---|---|---|
| PA | 0.4 | 0.9 | 1.1 | 1.7 | 3.1 | 4.4 |
| PA + Perb. | 0.9 | 0.6 | 0.8 | 1.8 | 3.5 | 8.0 |
| PA + Perb. + EDTMP | 0.3 | 0.9 | 1.2 | 2.7 | 5.1 | 9.1 |

PA = Triperoxytrimellitic acid.

TABLE 2f

| System | Bleach response (Δ R 460) wash temp. 30° C. wash time (min) 10 | 40° C. 20 | 50° C. 30 | 60° C. 40 | 70° C. 53 | 80° C. 65 |
|---|---|---|---|---|---|---|
| PA | 0.2 | 0.9 | 1.9 | 4.2 | 7.7 | 10.9 |
| PA + Perb. | 0.6 | 1.2 | 3.1 | 7.0 | 11.5 | 14.4 |
| PA + Perb. + EDTMP | 0.5 | 1.4 | 3.1 | 7.5 | 12.6 | 16.5 |

PA = Triperoxytrimesic acid.

TABLE 2g

| System | Bleach response (Δ R 460) wash temp. 30° C. wash time (min) 10 | 40° C. 20 | 50° C. 30 | 60° C. 40 | 70° C. 53 | 80° C. 65 |
|---|---|---|---|---|---|---|
| PA | −0.6 | 0.4 | 0.8 | 1.7 | 3.8 | 7.3 |
| PA + Perb. | 0.4 | 0 | 1.6 | 3.6 | 6.0 | 11.4 |
| PA + Perb. + EDTMP | −0.3 | 0.6 | 1.7 | 3.6 | 9.3 | 14.8 |

PA = Monoperoxysuccinic acid.

TABLE 2h

| System | Bleach Response (Δ R 460) wash temp. 30° C. | 40° C. | 50° C. | 60° C. | 70° C. | 80° C. |
|---|---|---|---|---|---|---|
| | wash time (min) 10 | 20 | 30 | 40 | 53 | 65 |
| PA | 0.1 | 1.1 | 1.4 | 4.8 | 8.6 | 11.9 |
| PA + Perb. | 0.3 | 0.8 | 2.3 | 5.9 | 9.4 | 13.3 |
| PA + Perb. + EDTMP | 0.2 | 1.3 | 2.4 | 8.2 | 12.0 | 15.2 |

PA = Diperoxyisophthalic acid.

EXAMPLE III

Bleach tests on tea stains were carried out using the spray-dried detergent base powder of Example I to which were added 2% by weight of diperoxyazelaic acid (DPAA), 10% by weight of sodium perborate tetrahydrate and 0.2% by weight of sequestrants. The sequestrants used were:

Seq. I(i)=ethylene diamine tetra(methylene phosphonic acid)

Seq. I(ii)=diethylene triamine penta (methylene phosphonic acid)

Seq. I(iii)=triethylene tetramine hexa(methylene phosphonic acid)

Seq. II=sequestrant of formula II, wherein n=1; X=H and Y=Z=$CH_2COOH$

Seq. III=sequestrant of formula III, wherein n=1 and X=H.

The bleach test results in heat-up wash cycles using detergent bleach compositions at 5 g/l product concentration expressed as ΔR 460 values as measured on the Elrepho spectroreflectometer are known in the following Tables.

TABLE 3a

| System | Bleach response (Δ R 460) wash temp. 40° C. | 50° C. | 60° C. | 70° C. | 80° C. |
|---|---|---|---|---|---|
| | wash time (min) 20 | 30 | 40 | 53 | 65 |
| DPAA | 1.4 | 3.6 | 6.6 | 11.3 | 13.9 |
| DPAA + Perb. | 1.5 | 3.5 | 7.5 | 12.5 | 15.8 |
| DPAA + Perb. + Seq.I(i) | 1.8 | 4.4 | 10.4 | 15.1 | 18.7 |

TABLE 3b

| System | Bleach Response (Δ R 460) wash temp. 40° C. | 50° C. | 60° C. | 70° C. | 80° C. |
|---|---|---|---|---|---|
| | wash time (min) 20 | 30 | 40 | 53 | 65 |
| DPAA | 1.3 | 1.9 | 5.5 | 9.8 | 11.6 |
| DPAA + Perb. | 1.6 | 2.6 | 6.3 | 10.2 | 13.1 |
| DPAA + Perb. + Seq. I(ii) | 1.6 | 3.9 | 8.7 | 12.9 | 16.2 |

TABLE 3c

| System | Bleach response (Δ R 460) wash temp. 40° C. | 50° C. | 60° C. | 70° C. | 80° C. |
|---|---|---|---|---|---|
| | wash time (min) 20 | 30 | 40 | 53 | 65 |
| DPAA | 1.0 | 2.5 | 5.6 | 9.0 | 11.6 |
| DPAA + Perb. | 1.2 | 2.5 | 7.2 | 9.9 | 14.4 |
| DPAA + Perb. + | | | | | |

TABLE 3c-continued

| System | Bleach response (Δ R 460) wash temp. 40° C. | 50° C. | 60° C. | 70° C. | 80° C. |
|---|---|---|---|---|---|
| | wash time (min) 20 | 30 | 40 | 53 | 65 |
| Seq. I(iii) | 0.9 | 3.3 | 8.9 | 12.0 | 14.2 |

TABLE 3d

| System | Bleach response (Δ R 460) wash temp. 40° C. | 50° C. | 60° C. | 70° C. | 80° C. |
|---|---|---|---|---|---|
| | wash time (min) 20 | 30 | 40 | 53 | 65 |
| DPAA | 1.3 | 1.9 | 5.5 | 9.8 | 11.6 |
| DPAA + Perb. | 1.6 | 2.6 | 6.3 | 10.2 | 13.1 |
| DPAA + Perb. + Seq. II | 1.6 | 4.2 | 9.1 | 13.5 | 16.7 |

TABLE 3e

| System | Bleach response (Δ R 460) wash temp. 40° C. | 50° C. | 60° C. | 70° C. | 80° C. |
|---|---|---|---|---|---|
| | wash time (min) 20 | 30 | 40 | 53 | 65 |
| DPAA | 1.4 | 3.6 | 6.6 | 11.3 | 13.9 |
| DPAA + Perb. | 1.5 | 3.5 | 7.5 | 12.5 | 15.8 |
| DPAA + Perb. + Seq. III | 2.6 | 4.4 | 9.1 | 14.4 | 17.4 |

I claim:

1. Solid detergent bleach composition having an improved bleaching effect at substantially all washing temperatures, consisting essentially of:

(a) from 3 to 40% by weight of a detergent selected from the group consisting of anionic, nonionic, cationic, and amphoteric detergent and mixtures thereof;

(b) from 1 to 25% by weight of a solid organic peroxyacid compound, having a melting point of at least 50° C.;

(c) from 2 to 40% by weight of an inorganic peroxy compound generating hydrogen peroxide in solution, and (d) from 0.05 to 5% by weight of a stabilizing sequestering agent selected from the group consisting of:

(i) a compound of the general formula:

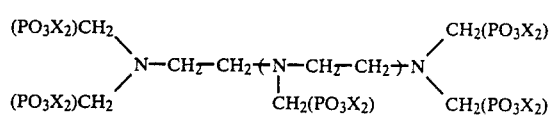

wherein n is an integer from 0 to 4 and X is H or an alkali metal, alkaline earth metal or ammonium cation;

(ii) a compound of the general formula:

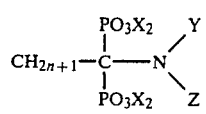

wherein n is an integer from 0 to 2; X is H or an alkali metal, alkaline earth metal or ammonium cation;

$Y = CH_2COOX$ or $CH_2PO_3X_2$ $Z = CH_2COOX$ or $CH_2PO_3X_2$ (X is H or alkali metal, alkaline earth metal or ammonium cation;

(iii) a compound of the general formula:

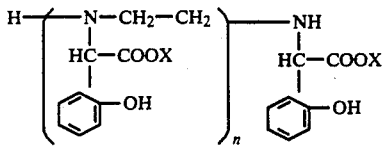

wherein n is 1–3, and X is H, or an alkali metal, alkaline earth metal or ammonium cation; and (iv) mixtures thereof.

2. Solid detergent bleach composition according to claim 1, which has:

(a) 10 to 35% by weight of said detergent;

(b) 2 to 10% by weight of said solid organic peroxyacid compound;

(c) 5 to 30% by weight of said inorganic peroxy compound; and (d) 0.1 to 2% by weight of said stabilizing sequestering agent.

3. Solid detergent bleach composition according to claim 1, wherein the peroxyacid compound is di-peroxyazelaic acid.

4. Solid detergent bleach composition according to claim 1, wherein said peroxy acid compound is monoperoxyphthalic acid.

5. Solid detergent bleach composition according to claim 1, wherein said peroxy acid compound is diperoxyisophthalic acid.

* * * * *